United States Patent [19]

Schellenberg

[11] Patent Number: 4,596,546

[45] Date of Patent: Jun. 24, 1986

[54] PROCESS AND APPARATUS FOR PERFORATING, STAMPING OR CREASING OF PAPER AND CARDBOARD IN ROTARY PRINTING PRESSES

[76] Inventor: Rolf Schellenberg, Alemannenweg 1, 8330 Pfaffikon, Switzerland

[21] Appl. No.: 572,672

[22] PCT Filed: May 9, 1983

[86] PCT No.: PCT/CH83/00057

§ 371 Date: Jan. 6, 1984

§ 102(e) Date: Jan. 6, 1984

[87] PCT Pub. No.: WO83/04004

PCT Pub. Date: Nov. 24, 1983

[30] Foreign Application Priority Data

May 17, 1982 [CH] Switzerland ..... 3042/82

[51] Int. Cl.[4] ..... B41F 13/56

[52] U.S. Cl. ..... 493/324; 83/347; 101/226; 101/DIG. 19

[58] Field of Search ..... 493/60, 324, 370, 365, 493/355; 83/678, 347, 332; 101/226, 426, 227, DIG. 19

[56] References Cited

U.S. PATENT DOCUMENTS

| | | | |
|---|---|---|---|
| 1,618,191 | 2/1927 | Hemberger | 83/678 |
| 1,668,258 | 5/1928 | Adsit | 101/226 |
| 2,842,202 | 7/1958 | Boyd | 164/100 |
| 3,147,658 | 8/1964 | Boyd | 83/678 |
| 3,250,152 | 5/1966 | Kirby et al. | 76/107 |
| 3,355,969 | 12/1967 | Sarka | 493/60 |
| 3,431,847 | 3/1969 | Smith et al. | 101/426 |
| 3,554,070 | 1/1971 | Boyd | 83/678 |
| 3,564,942 | 2/1971 | Wolfe | 493/60 |

FOREIGN PATENT DOCUMENTS

| | | |
|---|---|---|
| 898390 | 10/1953 | Fed. Rep. of Germany . |
| 500820 | 2/1971 | Switzerland . |
| 587107 | 4/1977 | Switzerland . |
| 1175092 | 12/1969 | United Kingdom . |

*Primary Examiner*—Francis S. Husar
*Assistant Examiner*—David B. Jones
*Attorney, Agent, or Firm*—Yount & Tarolli

[57] ABSTRACT

In a rotary printing press with a blanket cylinder (2) and an impression cylinder (3), the blanket is removed and replaced by a base sheet (5). On this base sheet (5) are arranged strips (6). The arrangement of the strips (6) corresponds to the perforation, stamping or creasing to be produced in the paper or cardboard passing through the rotary printing press. On the impression cylinder (3) is arranged a smooth protective sheet (7). Both sheets (5) and (7) can be used several times and can be installed or removed rapidly by means present on the machine.

6 Claims, 2 Drawing Figures

PROCESS AND APPARATUS FOR PERFORATING, STAMPING OR CREASING OF PAPER AND CARDBOARD IN ROTARY PRINTING PRESSES

SUMMARY OF THE INVENTION

The invention relates to a process for perforating, stamping or creasing of paper and cardboard in rotary printing presses by means of strips prepared in advance and arranged on a base sheet, the strips being placed on the base sheet before the beginning of the work cycle, outside the machine; as well as an apparatus for carrying out this process.

BACKGROUND OF THE INVENTION

An apparatus for carrying out stampings and perforations on printed or unprinted papers on rotary printing presses is known from U.S. Pat. No. 3,554,070. In this known device, the tools consist of angled strips with one long and one short leg. The short leg runs at right angles to the long leg and is designed as a cutting edge. Depending on the effect desired, the cutting edge is designed to be either continuous or interrupted. For perforating, for example, it is saw-tooth-like in form. The strips are provided with glue on the under surface of the long leg and are glued into position directly on the impression cylinder of known rotary printing presses. This impression cylinder is in contact, in the known way, with the blanket cylinder, which in turn is in contact with the plate cylinder. After the strips are arranged in the desired position on the impression cylinder, the paper to be processed is conducted between the impression and the blanket cylinders, and the cutting edges of the strips perforate the paper at the desired places. At the same time, a printed image may be transferred to the paper from the plate cylinder via the blanket stretched on the blanket cylinder.

In practice it has been found that a simultaneous printing and perforation or stamping of the paper is only possible at the cost of considerable lowering of quality of the printed product. The cutting edges of the strip, striking through the paper, damage the rubber blanket on the blanket cylinder and leave cuts in the rubber blanket surface. Thus, the rubber blanket can no longer be used for further printing runs and must be replaced. Moreover, the gluing of the strip-form tools to the impression cylinder is also time-consuming and costly. In the case of perfecting presses with roughened impression cylinders, the tools cannot be glued on, since they will not hold to the surface of the impression cylinder or will smear the freshly printed sheet. A further disadvantage found is that the leg of the strip bearing the cutting edge can only have a maximum height which corresponds to the distance between the surface of the impression cylinder and the surface of the rubber blanket on the blanket cylinder. Since in this space the support leg of the tool must also fit, the cutting edges do not extend over the whole height of the short leg, and the paper may either not be completely cut through, or raised places as well as tool marks are formed on the paper. As a result of the former, the paper parts cannot be perfectly separated from each other, and as a result of the latter, no high stacks of finished sheets of paper can be formed.

According to Swiss Pat. No. 587,107, the idea is known, in rotary stamping or die-cutting presses, of placing the cutting strip on a sheet by means of a binder, and then mounting this sheet on the stamping cylinder. The use of this process in rotary printing presses involves additional disadvantages, since the sheet mounted on the impression cylinder reduces the space between the impression cylinder and blanket cylinder, necessary to allow the paper to run through. In some types of machine, the placement of a sheet provided with strips on the impression cylinder is only possible with very great difficulty.

The present invention attacks the problem of avoiding the disadvantages of the known technology and providing a solution by which perforation, stamping or creasing of paper or cardboard on rotary printing presses can be carried out perfectly, without parts of the press or of the printing equipment being damaged. The solution should also make possible a shortened downtime of the rotary printing press and permit high work speeds.

The problem is solved by the invention, as to processing, by the fact that in a first work step, the rubber blanket is removed from the blanket cylinder and, in place of the blanket, a base sheet with pre-mounted strips is placed on the blanket cylinder. The base sheet is prepared outside the machine before stopping the rotary printing press, with the strips arranged in the desired position thereon. By changing the distance between the blanket cylinder and impression cylinder, the desired depth of tool engagement and the desired working pressure are set, at which time the paper or cardboard to be processed can be conducted between the blanket cylinder and the impression cylinder. In a further embodiment of the process, before the processing of the paper or cardboard, either simultaneously with or after the placing of the base sheet on the blanket cylinder, a second sheet is placed on the impression cylinder.

The apparatus for carrying out this process on rotary printing presses is distinguished by the fact that on the blanket cylinder, instead of the rubber blanket, there is located a base sheet on which are fastened strips which have a desired perforating, stamping or creasing profile, and that on the impression cylinder there is arranged a flat sheet. The strips have, advantageously, a T-shaped cross section, and the middle part is equipped with the desired profiling and cutting edge. In a further embodiment of the invention, the middle part of the strip is at least 1 mm high.

The advantages attained through the invention are mainly to be seen in the fact that, in the perforating, stamping or creasing of the paper or cardboard, neither the rubber blanket nor the sheet of paper or cardboard are damaged by the strips. By the removal of the rubber blanket, moreover, additional space is gained between the blanket cylinder and the impression cylinder, by which greater thicknesses of paper can be processed. The middle part of the strip, bearing the cutting edge, can also be designed to be high enough so that the cutting edge penetrates completely through the paper and no wrinkled places result. Also, tool marks on the paper can be eliminated. Moreover, there is an important shortening of the downtime of the machine, since the sheet with the strips can be prepared independently of the machine and mounted accurately and fastened by means already present on the blanket cylinder for the fastening of the blanket. The downtime of the machine can be shortened by at least 50% as compared with the process of gluing strips onto the impression cylinder. A further advantage is that the sheets can be used several times, since after the end of the finishing process, they can be removed from the blanket cylinder and stored. After removal of the base sheet with the strips, the blanket cloth can be remounted and the printing process continued. For similar perforation, stamping or creasing work, the prepared base sheet can be taken from storage and mounted instead of the blanket, on the blanket cylinder. This means that the strips can be used several times. Dull strips can also be sharpened to increase their life. This process according to the invention and the corresponding apparatus make it possible, even for print shops having only one rotary printing press and no stamping machine, to carry out perfect perforation, stamping and creasing jobs.

BRIEF DESCRIPTION OF THE DRAWINGS

Further details and features of the invention are explained in detail below from the drawings, which represent one form of execution.

DETAILED DESCRIPTION

Figure 1:
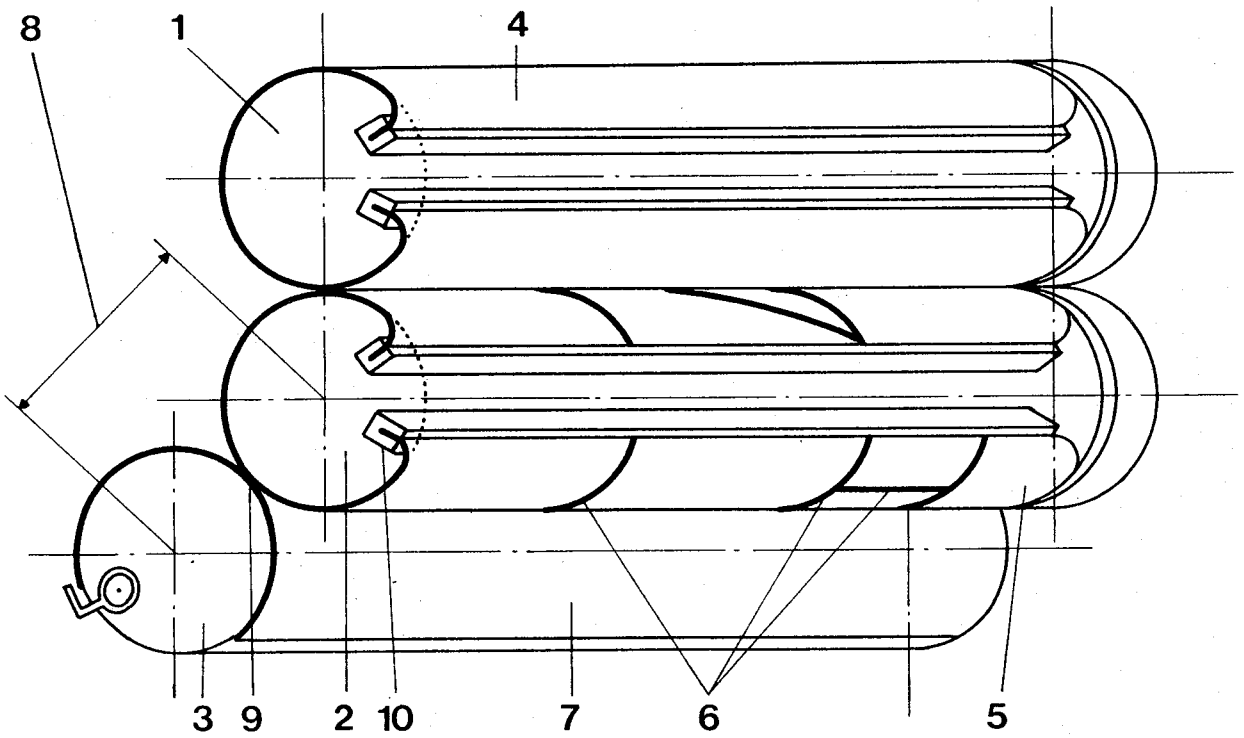
FIG. 1 is a schematic representation of the cylinder arrangement in rotary printing presses with the base sheet mounted in place.

The cylinder arrangement of a rotary printing press, shown in FIG. 1, consists of a plate cylinder 1, a blanket cylinder 2 and an impression cylinder 3. On the plate cylinder 1 is an offset plate 4, which can be removed when using the rotary printing press in a manner according to the invention. On the blanket cylinder 2 is stretched a base sheet 5, on the surface of which are arranged strips 6. A similar, but smooth, sheet 7 is also fastened to the impression cylinder 3. The axial distance 8, between the blanket cylinder 2 and the impression cylinder 3, can be adjusted and set by means of devices not shown. The space 9 between the cylinders 2 and 3, in the example described, with the cylinders brought together as closely as possible, amounts to 1.9 mm.

Figure 2:
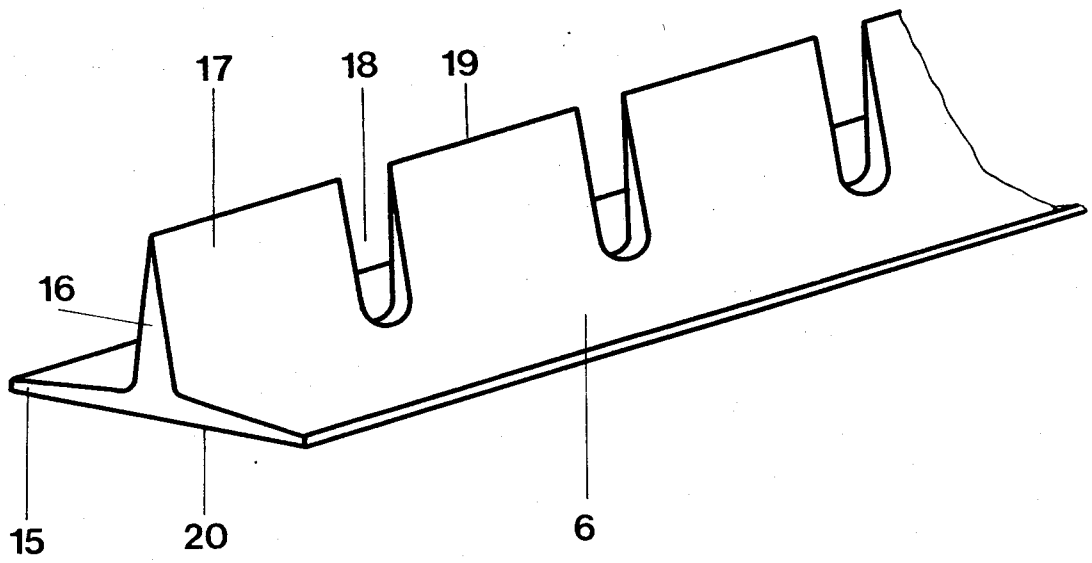
FIG. 2 is a partial view of a perforating strip.

In FIG. 2 is shown, as an example, a part of a strip 6, in this case a perforating strip. This perforating strip has a T-shaped cross section with a base 15 and a middle part 16. The middle part 16 is 1.9 mm high, including the thickness of the base 15. At its upper edge, the middle part 16 bears the cutting edge 19. The middle part 16 is interrupted by spacings 18, by which teeth are formed. The spacings 18 and the teeth 17, as well as the cutting edge 19, each have dimensions corresponding to the desired form of the profiling. The bottom surface 20 of the base 15 of the T has a double-sided adhesive strip which, when not in use, is protected by a covering strip.

To be able to process sheets of paper and cardboard by means of perforating, stamping or creasing, there is first fastened to a base sheet 5, known in print shop technology, the desired arrangement of strips 6. The thickness of the base sheets 5 and 7 amounts, in the example described, to about 0.25 mm in each case. The fastening of the strips 6 to the base sheet takes place when the sheet 5 is flat and is outside the rotary printing press. To do this, the protective strip on the bottom surface 20 is removed and this bottom surface 20 is glued, in the necessary position, onto the base sheet 5. As soon as a printing run in the rotary printing press has ended, the rubber blanket, not shown, is removed from the blanket cylinder 2, and in place of this blanket, the base sheet 5 is stretched onto the blanket cylinder 2 and fastened. The fastening may take place by means of the fastening means 10 present, or by supplementary means. The strips 6 conform along with the base sheet 5 to the surface of the blanket cylinder 2 and form thereby the rotating cutting surface for finishing the sheets of paper. In the example shown, a protective sheet 7, which is also known, is mounted on the impression cylinder 3. This is necessary when the impression cylinder 3 is roughened, as, for example, in Schondruck perfecting printing presses. Although the axial distance 8, or the space 9 between the blanket cylinder 2 and the impression cylinder 3, normally can be adjusted only with a small range, about ±0.5 mm after removing the blanket and applying the base sheet 5, a sufficiently great range of adjustment is given to make possible a perfect cutting by the strips 6 through the paper or cardboard conducted through the space 9. The strips 6 can be arranged in any desired way on the base sheet 5, so that all desired kinds of perforation, stamping or creasing can be produced. The dimensions chosen, in the example described, permit the finishing of sheets of cardboard with a weight of more than 300 grams per square meter. The depth of cutting depends on the height of the middle part 16, or of the teeth 17, and on the axial distance 8. After the finishing process, the base sheet 5 is removed from the blanket cylinder 2, without the position of the strips 6 being changed in any way. The sheet 5 is stored for later use and can be used again for a similar finishing process. To continue the printing run with the same rotary printing press, the blanket is again mounted on the blanket cylinder 2, and the protective sheet 7 removed from the impression cylinder 3. With this, the rotary printing press is ready for further work.

The changing of a normal rotary printing press from printing operation to the perforation, stamping or creasing operation according to the invention requires, depending on the size of the machine and of the base sheet, between 12 and 15 minutes. The methods and apparatus known up to now, in which the strips were glued onto the impression cylinder 3, required a time of at least 30 minutes. With methods known up to now, when returning to a printing operation, the strips had to be removed from the impression cylinder 3 and could not be used again for similar jobs.

What is claimed is:

1. A cutting method comprising the steps of:

converting into a cutter a rotary printing press having an impression cylinder and a blanket cylinder having a rubber blanket thereon, both of which cylinders are journalled at their opposite ends in respective bearings supported in a frame, said converting step including removing the rubber blanket from the blanket cylinder, providing a thin flexible sheet having first and second ends, securing at least one cutting, perforating or grooving strip in a desired position on the sheet, after securing the strip on the sheet, placing the sheet on the blanket cylinder by attaching the first end of the sheet to the blanket cylinder, rotating the blanket cylinder in its bearings to draw the sheet onto the blanket cylinder, and securing the second end of the sheet to the blanket cylinder, adjusting the distance between the blanket cylinder and the impression cylinder, and conducting a sheet of material between the blanket cylinder and the impression cylinder to effect cutting, perforating or grooving of the sheet of material by said cutter.

2. A method as defined in claim 1, further comprising the step of placing a second sheet on the impression cylinder simultaneously with or after placing the thin flexible sheet on the blanket cylinder, the second sheet having first and second ends, by attaching the first end of the second sheet to the impression cylinder, rotating the impression cylinder in its bearings to draw the second sheet onto the impression cylinder, and securing the second end of the second sheet to the impression cylinder.

3. A method as defined in claim 1, further comprising the step of mounting the strip on the thin flexible sheet when the sheet is substantially flat prior to removing the blanket from the blanket cylinder.

4. A method as defined in claim 1, further comprising the step of the strip having a T-shaped cross-section with a middle part carrying a cutting or creasing edge, and wherein the middle part is at least 1 mm high.

5. A method as defined in claim 3, further providing the strip having a T-shaped cross-section with a middle part carrying a cutting or creasing edge, and wherein the middle part is at least 1 mm high.

6. A method as defined in claim 1, further comprising the step of providing the rotary offset printing press with a plate cylinder having a printing plate mounted thereon, and further comprising the step of removing the printing plate from the plate cylinder prior to conducting the sheet of material between the blanket cylinder and the impression cylinder.

* * * * *